US007638016B2

(12) United States Patent
Nguyen

(10) Patent No.: US 7,638,016 B2
(45) Date of Patent: Dec. 29, 2009

(54) METHOD FOR TREATING KRAFT PULP WITH OPTICAL BRIGHTENERS AFTER CHLORINE BLEACHING TO INCREASE BRIGHTNESS

(75) Inventor: Xuan Truong Nguyen, Cincinnati, OH (US)

(73) Assignee: International Paper Company, Memphis, TN (US)

( * ) Notice: Subject to any disclaimer, the term of this patent is extended or adjusted under 35 U.S.C. 154(b) by 65 days.

(21) Appl. No.: 11/445,809

(22) Filed: Jun. 2, 2006

(65) Prior Publication Data

US 2007/0193707 A1 Aug. 23, 2007

Related U.S. Application Data

(63) Continuation-in-part of application No. 11/358,543, filed on Feb. 21, 2006.

(60) Provisional application No. 60/654,712, filed on Feb. 19, 2005.

(51) Int. Cl.
*D21C 3/22* (2006.01)
*D06L 3/12* (2006.01)

(52) U.S. Cl. ..... 162/70; 162/72; 8/648

(58) Field of Classification Search ..... 162/70, 162/162; 8/648
See application file for complete search history.

(56) References Cited

U.S. PATENT DOCUMENTS

| | | | | |
|---|---|---|---|---|
| 2,527,563 | A * | 10/1950 | Mcewen | 162/78 |
| 4,169,810 | A | 10/1979 | Gunther et al. | |
| 4,187,141 | A | 2/1980 | Ahrel | |
| 5,002,635 | A | 3/1991 | Gentile, Jr. et al. | |
| 5,223,090 | A * | 6/1993 | Klungness et al. | 162/9 |
| 5,389,201 | A | 2/1995 | Tsai | |
| 5,482,514 | A | 1/1996 | Von Raven et al. | |
| 5,616,280 | A | 4/1997 | Moore et al. | |
| 5,759,349 | A * | 6/1998 | Foster et al. | 162/158 |
| 5,902,454 | A | 5/1999 | Nelson | |
| 6,379,497 | B1 | 4/2002 | Sandstrom et al. | |
| 6,426,382 | B1 | 7/2002 | Farrar et al. | |
| 6,599,326 | B1 * | 7/2003 | Seltzer et al. | 8/101 |
| 6,723,846 | B1 | 4/2004 | Metzger et al. | |
| 6,890,454 | B2 | 5/2005 | Farrar et al. | |
| 6,893,473 | B2 | 5/2005 | Neogi et al. | |
| 2002/0084049 | A1 | 7/2002 | Engelhardt | |
| 2003/0013628 | A1 | 1/2003 | Farrar et al. | |
| 2004/0014910 | A1 | 1/2004 | Wang | |

(Continued)

FOREIGN PATENT DOCUMENTS

| | | |
|---|---|---|
| EP | 0899373 | 3/1999 |
| EP | 0905317 | 3/1999 |
| GB | 1239818 | 7/1971 |

(Continued)

OTHER PUBLICATIONS

Smook, Handbook for Pulp and Paper Technologists, 1992, Angus Wilde Publications, 2nd edition, Chapter 13.*

(Continued)

*Primary Examiner*—Eric Hug
*Assistant Examiner*—Anthony J Calandra
(74) *Attorney, Agent, or Firm*—Thomas W. Barnes, III; Richard C. Stewart, II; John K. Pike

(57) ABSTRACT

The present invention relates to a method of increasing the brightness of pulp, pulp made from such methods and methods of using such pulp.

16 Claims, 11 Drawing Sheets

FOREIGN PATENT DOCUMENTS

| | | |
|---|---|---|
| GB | 1591322 | 6/1991 |
| WO | WO96/00221 | 1/1996 |
| WO | WO99/32710 | 7/1999 |
| WO | WO2006/089274 | 8/2006 |
| WO | WO2006/110751 | 10/2006 |

OTHER PUBLICATIONS

Gullichsen et al., Chemical Pulping 6A,1999, Fapet 0y,pg. A158-A159, A642-A643.*

Gullichsen et al., Chemical Pulping 6A, 1999, Fapet Oy, A180-A181 A656-A662.*

Handbook for Pulp & Paper Technologies, 2nd Edition, G.A. Smook, Angus Wilde Publications 1992.

Ullmann's Encyclopedia of Industrial Chemistry, Sixth Edition, 2000 Electronic Release, Optical Brighteners—Chemistry of Technical Products.

The Bleaching of Pulp, 3rd Edition, RP Singh, TAPPI Press, Atlanta, GA 1979.

* cited by examiner

METHOD FOR TREATING KRAFT PULP WITH OPTICAL BRIGHTENERS AFTER CHLORINE BLEACHING TO INCREASE BRIGHTNESS

This application claims priority from U.S. application having Ser. No. 11/358,543, filed Feb. 21, 2006, and entitled "pulp and paper having increased brightness", which claims the benefit of priority under 35 U.S.C. 119(e) to U.S. provisional patent application having Ser. No. 60/654,712, filed Feb. 19, 2005, both of which are hereby incorporated, in their entirety, herein by reference.

FIELD OF THE INVENTION

The present invention relates to a method of increasing the brightness of pulp, pulp made from such methods and methods of using such pulp.

BACKGROUND OF THE INVENTION

Bleaching is a common method for increasing the whiteness of pulp. Industry practice for improving appearance of fluff pulp is to bleach the pulp to ever-higher levels of brightness (the Technical Association of the Pulp & Paper Industry ("TAPPI") or the International Organization for Standardization ("ISO")). However, bleaching is expensive, environmentally harsh and often is a source of manufacturing bottleneck. Widespread consumer preference for a brighter, whiter pulp drives manufacturers to pursue ever more aggressive bleaching strategies. While highly bleached pulps are "whiter" than their less-bleached cousins, they are still yellow-white in color. A yellow-white product is undesirable. Countless studies suggest that consumers clearly favor a blue-white over a yellow-white color. The former is perceived to be whiter, i.e., "fresh", "new" and "clean", while the latter is judged to be "old", "faded", and "dirty".

While bleaching directly elevates brightness, it only indirectly elevates whiteness. Due to the latter, bleaching is not always the most efficient method for boosting product whiteness. For example, even after aggressive bleaching, a product's whiteness can always be extended beyond that achievable with bleaching alone by judicious addition of colorant.

The practice of pre-coloring papermaking pulp is not usually done nor is it necessarily desired. With the former, intentional alteration of optical properties often ends up degrading product specifications such as TAPPI brightness, which is undesirable. With the latter, one runs the risk that colorants may not survive the unpredictable manufacturing environments of downstream processes. This is because previously applied colorant can be adversely affected chemically and/or physically during post-processing operations resulting in unexpected or undesirable color changes or even full loss of color. Furthermore, some colorants can be lost or rendered ineffective during various post-processing operations disrupting process health and reliability. Therefore, any optical enhancement is usually accomplished by addition of tinting colorants, fillers, and/or fluorescent dye during the papermaking stage. A process for enhancing the whiteness, brightness, and chromaticity of papermaking fibers has been described in U.S. Pat. No. 5,482,514. The process relates to adding photoactivators, particularly water-soluble phthalocyanines, to papermaking fibers to enhance their optical properties by a catalytic photosensitizer bleaching process. The resulting bleached papermaking fibers can be advantageously incorporated into paper sheets.

With fluff pulp, as well as most pulp and paper products, TAPPI brightness serves as the de facto standard in lieu of an industry-specific whiteness specification such as CIE Whiteness (Commission Internationale d'Eclairage). Because of this, brightness serves two key roles. First, brightness is a manufacturing parameter. Second, brightness is a specification for classifying finished product grades. The implicit, but dubious, assumption to this day has been that brightness is equivalent to whiteness. Common papermaking practice is to either add blue tinting dyes or tinting pigments and/or different types of blue-violet fluorescent dyes to boost whiteness properties. Tinting colorants are either finely ground colored pigments suspended in a dispersant or synthetically produced direct dyes. Tinting dyes have some affinity to cellulose while tinting pigments have little to none.

Fluorescent whitening agents (FWA) or optical brightening agents (OBA) are used in the pulp and paper industry are of three types: di-, tetra-, or hexasulphonated stilbene compounds, for example. These chemicals require ultraviolet (UV) light to excite fluorescence. While there is strong UV content in daylight, even common office lights produce enough UV light to permit some excitation. During papermaking, OBAs are added at the wet end of papermaking processes, which include for example, the machine chest and/or the fan pump, where the fiber solution is at low consistencies that are less than about 3% solids. At these conventional addition points, much OBA is lost to waste as the OBA does not necessarily have a strong affinity to the fibers in solution. Accordingly, the OBA must be added at high concentrations (lbs/ton of fiber or pulp) in order to achieve high quality fibers having high brightness and high brightness improvements.

Accordingly, there exists a need for a pulp having improved whiteness and brightness. A need also exists for a method for making whitened/brightened pulp for any use, especially papermaking and fluff pulp, while using less OBA to obtain such levels of whiteness and brightness at less cost. The present invention seeks to fulfill these needs and provides further related advantages.

SUMMARY OF THE INVENTION

One aspect of this invention relates to a method of brightening pulp fibers comprising contacting a plurality of the fibers with at least one optical brightener at any time after the last bleaching/extraction stage with a chlorine based bleaching agent and up to and prior to treatment of the fibers with papermaking chemicals as for example at the. Another aspect of this invention relates to brightened pulp fibers produced by the method of this invention preferably having a CIE whiteness that is not less than 130, an ISO brightness that is not less than 90 or a CIE whiteness that is not less than 130 and an ISO brightness that is not less than 90. Yet another aspect of this invention relates to a paper or paperboard substrate comprising the pulp fibers of this invention.

DETAILED DESCRIPTION OF THE INVENTION

Figure 1:
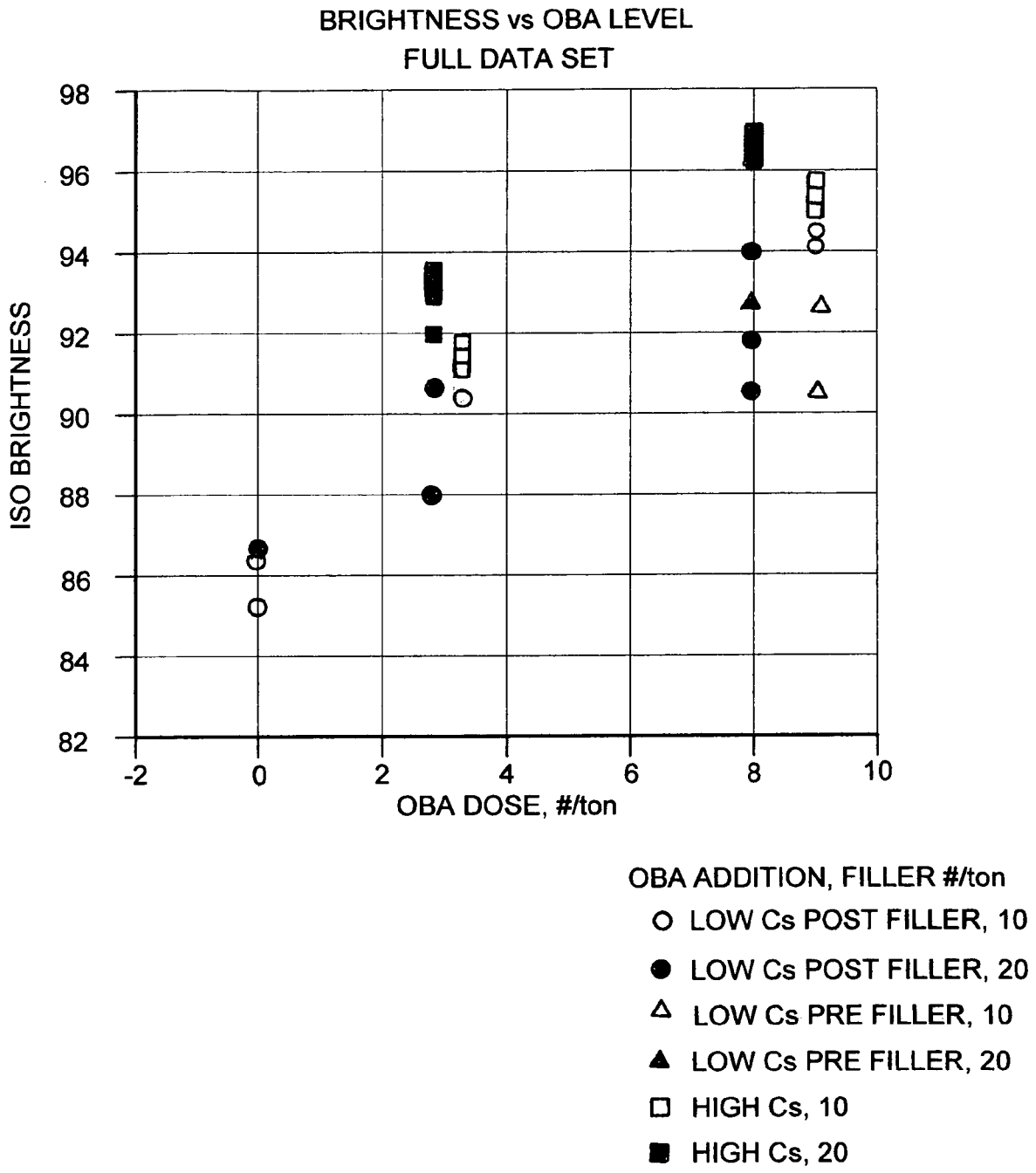
FIG. 1: Graphs of ISO Brightness v.s OBA Level of Handsheets made from pulp treated with OBA, full data set.
Figure 2:
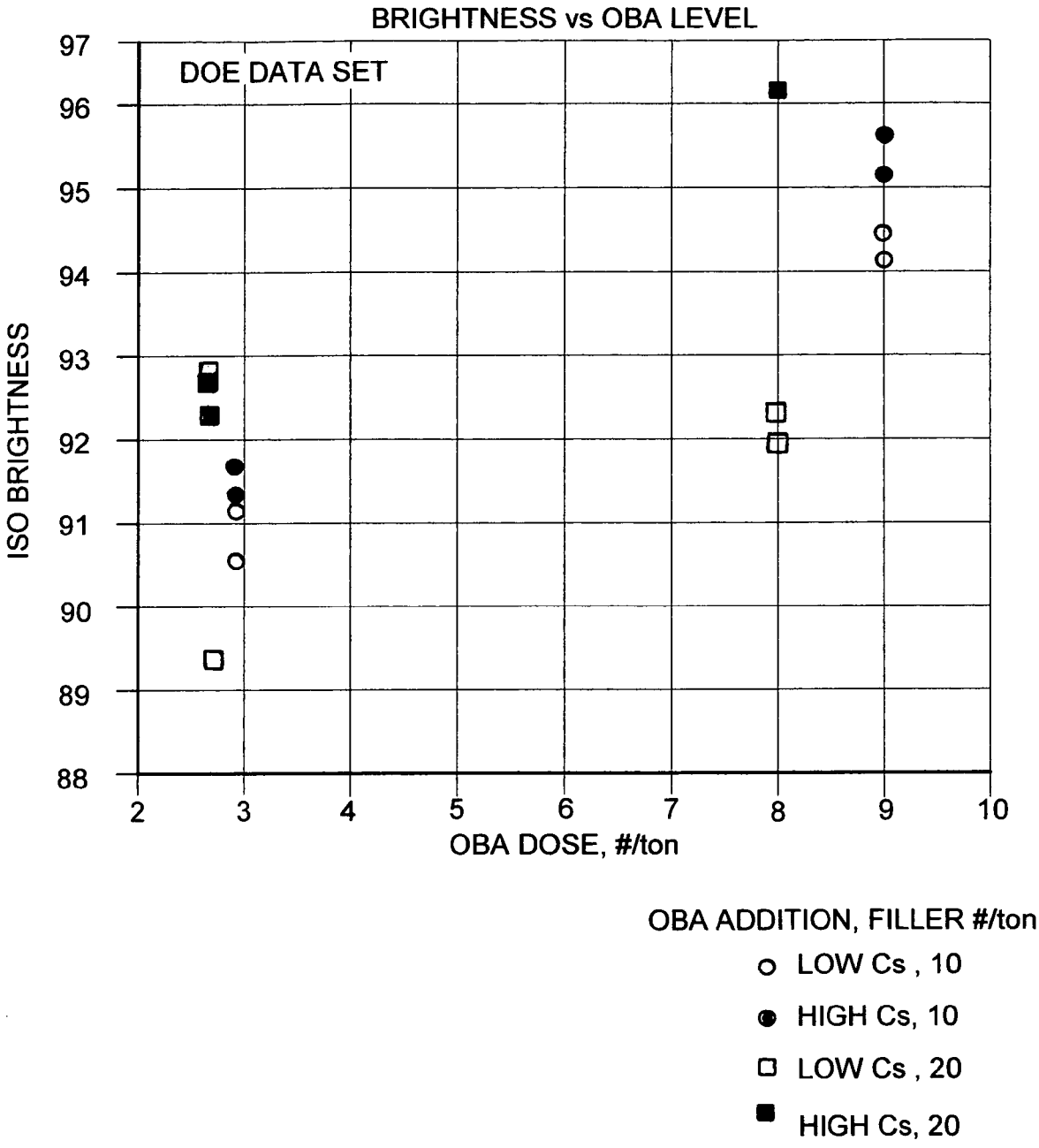
FIG. 2: Graphs of ISO Brightness v.s OBA Level of Handsheets made from pulp treated with OBA, dose data set.
Figure 3:
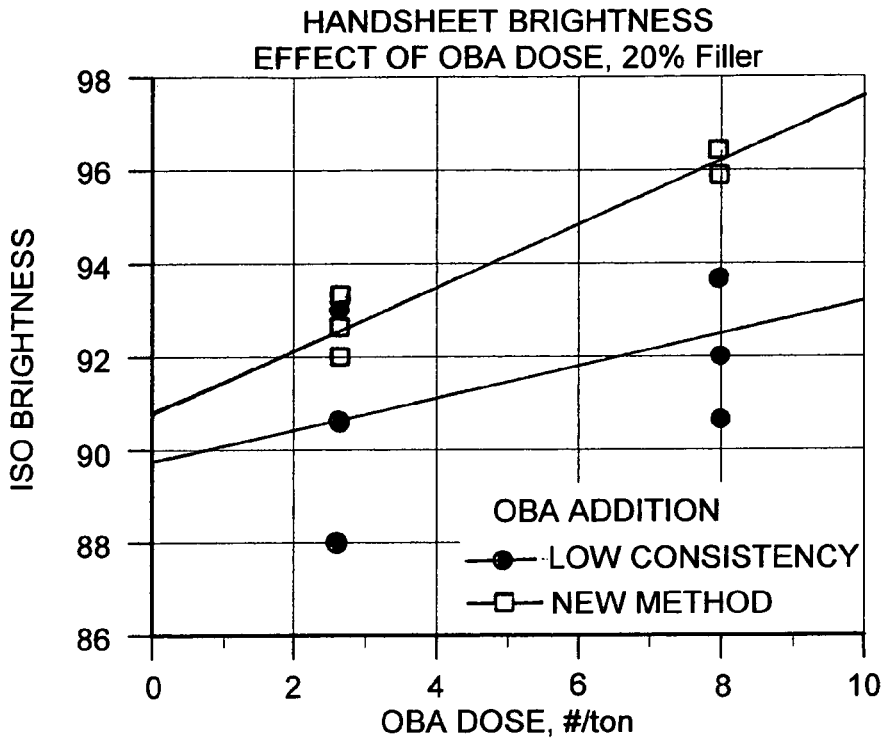
FIG. 3: Graphs of ISO Brightness v.s OBA Level of Handsheets made from pulp treated with OBA, effect of OBA dose in the presence of 10 and 20% filler.
Figure 3:
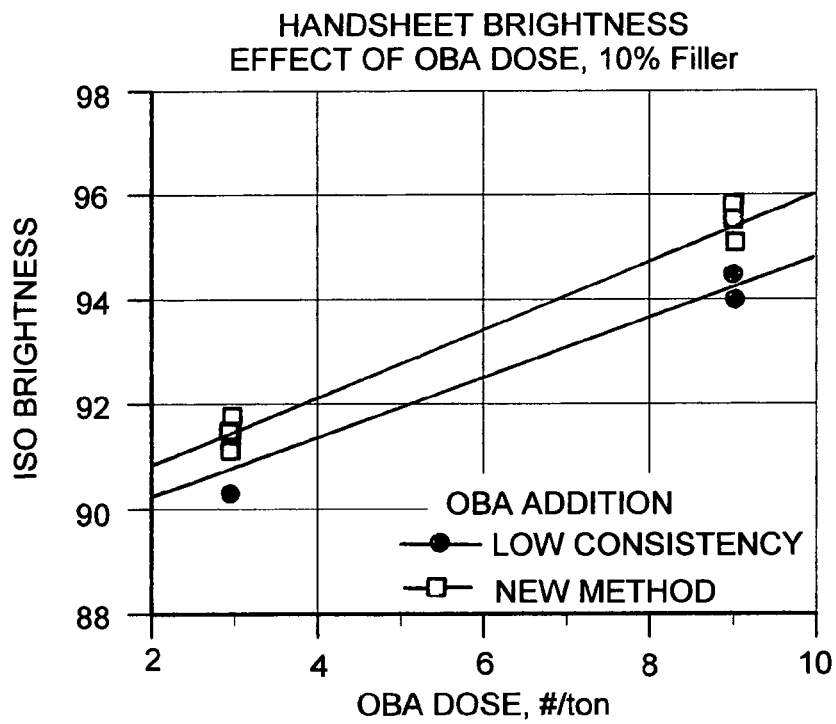

The present inventor has surprisingly found a method of efficiently increasing the brightness and whiteness of pulp and paper while using less OBA applied thereto, thereby providing for a much more efficient manner of providing a fiber-OBA complex containing greater fiber-OBA interaction on the whole than conventional methodologies of creating a fiber-OBA complex. Such a fiber-OBA complex made by the method according to the present invention has greater increases in brightness and whiteness than the fiber alone as compared to traditional methodologies as described below.

The present invention relates, in part, to a method of making pulp. The pulp may be fluff or papermaking pulp. The method may be used and added to any traditional methods of making papermaking or fluff pulp. The pulp may be used in any conventional uses of pulp, including any conventional papermaking processes of making paper and/or paperboard substrates. Such conventional pulp and papermaking processes in the pulp, paper and paperboard art may be found, for example, in "Handbook For Pulp & Paper Technologies", $2^{nd}$ Edition, G. A. Smook, Angus Wilde Publications (1992) and references cited therein, which are hereby incorporated, in their entirety, herein by reference.

A typical pulp/paper making process may include, but is not limited to, the following stages:

A. Digesting stage where wood chips are digested to release pulp fibers from the lignin;

B. Brownstock Washing Stage where the pulp from the Digesting Stage is washed;

C. Bleaching/Extraction Stages where the pulp is extracted with and bleached with various chemicals such as oxygen in oxygen delignification, chlorine dioxide, elemental chlorine, peroxide, ozone, and the like followed by one or more washing stages;

D. High Density Storage Stage where the bleached/washed pulp is stored at relatively high density as for example preferably more than about 7%, more preferably from about 7.5 to about 15%, and most preferably from about 10 to about 12%;

E. Low Density Storage Stage where the bleached/washed pulp is stored at relatively low density as for example preferably equal to or less than about 7%, more preferably from about 3% to 7%, and most preferably from about 10 to about 12%;

F. Pulp Refining Stage where the pulp is refined at a consistency preferably of from about 4 to about 5%;

G. Blend Chest/Machine Chest Stages where the pulp having a consistency preferably from about 3 to about 4% is mixed with wet end chemicals used in paper making such as fillers, retention aids, dyes and optical brighteners and the like. Such a traditional processes may include repeats of any one or more of the above-mentioned steps. In addition, the present invention may be combined with traditional methods of adding OBA to fibers, such as the conventional wet-end addition points as well as size press addition points and coating addition points, when making paper and/or paperboard.

The present invention relates, in part, to a method of adding OBA to fibers at any point after the last bleaching/extraction stage with chlorine based bleaching agents such as elemental chlorine and chlorine dioxide and up to and prior to treatment of pulp with papermaking chemicals such as in the Blend Chest/Machine Chest Stages. For example, the pulp fibers can be treated during any non-chlorine based bleaching/extraction stage after the last chlorine based bleaching stage, if any. Illustrative of such non-chlorine bleaching stages are those in which the pulp is treated with oxygen, ozone, peroxides, per-oxy acids, acid derivatives of hydrogen peroxide (such as peroxymono sulfuric acid and peroxyacetic acid), dimethyl dioxirane, sodium hydrosulfite, sodium bisulfite, zinc hydrosulfite and any other non-chlorine based bleaching such as those described in "The Bleaching of Pulp" $3^{rd}$ Ed. RP. Singh, TAPPI PRESS, Atlanta, Ga. 1979. As further examples, the pulp can be treated with the OBA in High Density Storage Stage where the bleached/washed pulp is stored at relatively high density; in Low Density Storage Stage where the bleached/washed pulp is stored at relatively low density; in Pulp Refining Stage where the pulp is refined at a consistency preferably of from about 4 to about 5%; or any combination thereof.

The source of the fibers may be from any fibrous plant. Examples of such fibrous plants are trees, including hardwood and softwood fibrous trees, including mixtures thereof. In certain embodiments, at least a portion of the pulp fibers may be provided from non-woody herbaceous plants including, but not limited to, kenaf, hemp, jute, flax, sisal, or abaca although legal restrictions and other considerations may make the utilization of hemp and other fiber sources impractical or impossible. Either bleached or unbleached pulp fiber may be utilized in the process of this invention. The fibers can be recycled fibers, deinked fibers and/or virgin fibers, but are preferably virgin fibers.

The pulp of the present invention may contain from 1 to 99 wt %, preferably from 5 to 95 wt %, cellulose fibers originating from hardwood species and/or softwood species based upon the total amount of cellulose fibers. This range includes 1, 2, 5, 10, 15, 20, 25, 30, 35, 40, 45, 50, 55, 60, 65, 70, 75, 80, 85, 90, 95, and 100 wt %, including any and all ranges and subranges therein, based upon the total amount of cellulose fibers.

When the pulp may contain both hardwood and softwood fibers, it is preferable that the hardwood/softwood ratio be from 0.001 to 1000. This range may include 0.001, 0.002, 0.005, 0.01, 0.02, 0.05, 0.1, 0.2, 0.5, 1, 2, 5, 10, 15, 20, 25, 30, 35, 40, 45, 50, 55, 60, 65, 70, 75, 80, 85, 90, 95, 100, 200, 300, 400, 500, 600, 700, 800, 900, and 1000 including any and all ranges and subranges therein and well as any ranges and subranges therein the inverse of such ratios.

Optical brightening agents ("OBAs") used in the practice of the process of this invention may vary widely and any conventional OBA used or which can be used to brighten mechanical or Kraft pulp can be used in the conduct of the process of this invention. Optical brighteners are dye-like fluorescent compounds which absorb the short-wave ultraviolet light not visible to the human eye and emit it as longer-wave blue light, with the result that the human eye perceives a higher degree of whiteness and the degree of whiteness is thus increased. This provides added brightness and can offset the natural yellow cast of a substrate such as paper. Optical brighteners used in the present invention may vary widely and any suitable optical brightener may be used. An overview of such brighteners is to be found, for example, in Ullmann's Encyclopedia of Industrial Chemistry, Sixth Edition, 2000 Electronic Release, OPTICAL BRIGHTENERS—Chemistry of Technical Products which is hereby incorporated, in its entirety, herein by reference. Other useful optical brighteners are described in U.S. Pat. Nos. 5,902,454; 6,723,846; 6,890,454; 5,482,514; 6,893,473; 6,723,846; 6,890,454; 6,426,382; 4,169,810; and 5,902,454 and references cited therein which are all incorporated by reference. Still other useful optical brighteners are described in; and U.S. Pat. Application Publication Nos. US 2004/014910 and US 2003/0013628; and WO 96/00221 and references cited therein which are all incorporated by reference. Illustrative of useful optical brighteners are 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans or oxanilides.

Most commercially available optical brightening agents are based on stilbene, coumarin and pyrazoline chemistries and these are preferred for use in the practice of this invention. More preferred optical brighteners for use in the practice of this invention are optical brighteners typically used in the paper industry based on stilbene chemistry such as 1,3,5-triazinyl derivatives of 4,4'-diaminostilbene-2,2'-disulfonic acid and salts thereof, which may carry additional sulfo groups, as for example at the 2, 4 and/or 6 positions. Most preferred are the commercially available stilbene derivatives as for example those commercially available from Ciba Geigy under the tradename "Tinopal", from Clariant under the tradename "Leucophor", from Lanxess under the tradename "Blankophor" , and from 3V under the tradename "Optiblanc" such as disulfonate, tetrasulfonate and hexasulfonate stilbene based optical brightening agents. Of these most preferred commercial optical brightening agents, the commercially available disulfonate and tetra sulfonate stilbene based optical brightening agents are more preferred and the commercially available disulfonate stilbene based optical brightening agents is most preferred. While the present invention prefers methods and fiber-OBA complexes using the above-mentioned OBA, the present invention is in no way limited to such exemplified embodiments and any OBA may be utilized.

The present invention relates in part, to a fiber:OBA complex in which the affinity of the OBA added to the fiber according to present invention is preferably greater than that when the OBA is added to the fiber conventionally. When the OBA is added to the fiber according to the method of the present invention, there is 30 to 60% reduction in the OBA required to be added than that of conventional methods and addition points. The reduction may be 30, 31, 32, 33, 34, 35, 40, 45, 50, 55, 56, 57, 58, 59, and 60% compared to that required in conventional methods and addition points, including any and all ranges and subranges therein.

The increased affinity of the OBA to the fiber may be measured by extraction methods using any solvent, preferably water, at any temperature. Because the OBA has increased affinity to the fiber overall in the present inventive pulps and paper substrates made therefrom compared to conventional pulp, it will take a longer period of time for the OBA to be extracted from the pulp:OBA complex of the present invention (pulp and/or paper) at a given time period and temperature for a given solvent.

In addition, the present invention preferably relates to a method of increasing the penetration of OBA into the cell wall of a fiber. Preferably, there is a greater amount of OBA that has penetrated the cell wall of a fiber treated according to the present invention than that of fibers treated by conventional methods. More preferably, the amount of OBA present within the cell wall of the fiber is increased by at least 1% than the amount of OBA present within the cell wall of fiber that was treated in conventional methods. However, it is more preferred that the amount of OBA present within the cell wall of the fiber is increased by at least 2, 3, 4, 5, 6, 7, 8, 9, 10, 15, 20, 25, 30, 35, 40, 45, 50, 55, 60, 65, 70, 75, 80, 85, 90, 100, 200, 300, 500, and 1000% than the amount of OBA present within the cell wall of fiber that was treated in conventional methods, including any and all ranges and subranges therein.

More preferably, at least about 1% of the cell wall of the is penetrated by the OBA. However, it is more preferred that at least 2, 3, 4, 5, 6, 7, 8, 9, 10, 15, 20, 25, 30, 35, 40, 45, 50, 55, 60, 65, 70, 75, 80, 85 or 90% of the cell wall has been penetrated by OBA, including any and all ranges and subranges therein.

The amount of OBA present within the cell wall of fiber may be measured, for example, by microscopy, more specifically fluorescent microscopy.

While any amount of OBA may be added to the fiber so long as it is added at any point after the last bleaching/extraction stage and up to and prior to the Blend Chest/Machine Chest Stages, it is preferable that from 1 to 60 lbs of OBA per ton of fiber, more preferably not more then 30 lbs/ton, most preferably, not more than 15 lbs/ton OBA/fiber. This range includes 60, 55, 50, 45, 40, 30, 35, 30, 25, 20, 15, 14, 13, 12, 11, 10, 9, 8, 7, 6, 5, 4, 3, 2, and 1 lbs of OBA per ton of fiber (lbs/ton) including any and all ranges and subranges therein.

In addition, the fiber may be in the solution or slurry, or added to the solution or slurry at the same time, as the OBA. Preferably, the fiber is in solution or slurry prior to contacting the OBA thereto. In one embodiment of the present invention, the fiber may have any consistency. However, it is preferably to have a consistency that is equal to or greater than 4% solids, more preferably, not less than about 5% solids, most preferably, not less than about 10% solids. In addition, it is preferable that the fibers have a consistency that is not more than about 35% solids, preferably not more than 20% solids, more preferably not more than about 15% solids. These ranges include 2, 3, 4, 5, 6, 7, 8, 9, 10, 11, 12, 13, 14, 15, 16, 17, 18, 19, and 20% solids as the fiber consistency at the time the OBA is added thereto, including any and all ranges and subranges therein.

At the time of the addition of the OBA to the fiber, the pH may be any pH. Preferably, the pH may range from 2.5 to 8.0, more preferably from 3.5 to 5.5. This range includes 2.5, 3.0, 3.5, 4.0, 4.5, 5.0, 5.5, 6.0, 6.5, 7.0, 7.5, and 8.0, including any and all ranges and subranges therein.

At the time of the addition of the OBA to the fiber, the temperature may be any temperature. However, it is preferable that means be applied, such as heating, so as to generate a temperature that is from 35 to 95° C., preferably from 50 to 90° C., more preferably from 60 to 80° C. This range includes 35, 40, 45, 50, 55, 60, 61, 62, 63, 64, 65, 66, 67, 68, 69, 70, 71, 72, 73, 74, 75, 76, 77, 78, 79, 80, 85, 90 and 95° C., including any and all ranges and subranges therein.

The time in which the OBA is contacted with the fiber may be for any duration of time. Preferably, the OBA and fiber may be contacted from 30 minutes to 12 hours, more preferably from 45 minutes to 8 hours, most preferably from 1 hour to 6 hours. This range includes 0.5, 0.75, 1, 1.25, 1.5, 1.75, 2, 2.25, 2.5, 2.75, 3, 3.25, 3.5, 3.75, 4, 4.25, 4.5, 4.75, 5, 5.25, 5.5, 5.75, 6, 6.5, 7, 7.5, 8, 8.5, 9, 9.5, 10, 11, and 12 hrs, including any and all ranges and subranges therein.

At the time of contacting the OBA with the fiber, retention aids may optionally be present or added therewith. Alum and/or cationic retention aids are examples of such retention aids. Examples of retention aids is found in U.S. Provisional Patent Application 60/660703, filed Mar. 11, 2005, and U.S. Pat. No. 6,379,497, which are hereby incorporated, in their entirety, herein by reference. However, any retention aid commonly used with OBAs may be used. While the retention aid may be present in any amount, or not at all, preferably, the amount of retention aid present is less than that required during conventional processes and addition points used to contact OBA with fibers. Most preferably, no retention aids are used. If retention aids are used, it is preferable that there is at least a 1% reduction in the amount of retention aid present as compared to that of conventional methods and addition points for contacting OBA with fiber. The preferred reduction is at least 2, 3, 4, 5, 10, 15, 20, 25, 30, 35, 40, 50, 60, 75, 100, 200, 300, 500, and 1000% reduction in the amount of retention aid present in the present invention as compared to conventional methods and addition points for contacting OBA with fiber, including any and all ranges and sub-ranges therein.

While the fiber may be refined at any time, preferably, the fiber is refined after the OBA is contacted with the fiber. Therefore, the fiber:OBA complex of the present invention is refined. Accordingly, any conventional refining may occur, including but not limited the chemical refining, mechanical refining, thermochemical refining, thermomechanical refining, chemithermomechanical refining, etc may occur. Therefore the pulp produced may include TMP, CTMP, MP, BCTMP, etc.

The pulp of the present invention and method of making the same may be incorporated into any traditional papermaking process. The pulp and/or paper substrate may also include other conventional additives such as, for example, starch, mineral and polymeric fillers, sizing agents, retention aids, and strengthening polymers. Among the fillers that may be used are organic and inorganic pigments such as, by way of example, minerals such as calcium carbonate, kaolin, and talc and expanded and expandable microspheres. Other conventional additives include, but are not restricted to, wet strength resins, internal sizes, dry strength resins, alum, fillers, pigments and dyes. Dyes that are especially preferably are those of the blue dye type which are capable of increasing the CIE Whiteness of the pulp and/or paper substrate. Preferably, pulp and paper substrate of the present invention made according to the present invention is capable of achieving CIE Whiteness that is much higher than conventional pulps and substrates made by conventional methods, even at CIE Whiteness levels that usually result in decreased ISO brightness levels.

The pulp and/or paper substrate of the present invention may have any CIE whiteness, but preferably has a CIE whiteness of greater than 70, more preferably greater than 100, most preferably greater than 125 or even greater than 150. The CIE whiteness may be in the range of from 125 to 200, preferably from 130 to 200, most preferably from 150 to 200. The CIE whiteness range may be greater than or equal to 70, 80, 90, 100, 110, 120, 125, 130, 135, 140, 145, 150, 155, 160, 65, 170, 175, 180, 185, 190, 195, and 200 CIE whiteness points, including any and all ranges and subranges therein. Examples of measuring CIE whiteness and obtaining such whiteness in a fiber and paper made therefrom can be found, for example, in U.S. Pat. No. 6,893,473, which is hereby incorporated, in its entirety, herein by reference.

Preferably, the pulp and/or paper substrate of the present invention has a CIE whiteness that is increased over conventional pulp and/or paper substrates made by conventional methods. The preferred increase is at least 2, 3, 4, 5, 10, 15, 20, 25, 30, 35, 40, 50, 60, 75, 100, 200, 300, 500, and 1000% increase in CIE whiteness as compared to that of conventional pulps, paper substrates made by conventional methods and addition points for contacting OBA with fiber, including any and all ranges and sub-ranges therein.

The pulp and paper substrate of the present invention may have any ISO brightness, but preferably greater than 80, more preferably greater than 90, most preferably greater than 95 ISO brightness points. The ISO brightness may be preferably from 80 to 100, more preferably from 90 to 100, most preferably from 95 to 100 ISO brightness points. This range include greater than or equal to 80, 85, 90, 91, 92, 93, 94, 95, 96, 97, 98, 99, and 100 ISO brightness points, including any and all ranges and subranges therein. Examples of measuring ISO brightness and obtaining such brightness in a papermaking fiber and paper made therefrom can be found, for example, in U.S. Pat. No. 6,893,473, which is hereby incorporated, in its entirety, herein by reference.

Preferably, the pulp and/or paper substrate of the present invention has an ISO brightness that is increased over conventional pulp and/or paper substrates made by conventional methods. The preferred increase is at least 2, 3, 4, 5, 10, 15, 20, 25, 30, 35, 40, 50, 60, 75, 100, 200, 300, 500, and 1000% increase in an ISO brightness as compared to that of conventional pulps, paper substrates made by conventional methods and addition points for contacting OBA with fiber, including any and all ranges and sub-ranges therein.

The present invention is explained in more detail with the aid of the following embodiment example which is not intended to limit the scope of the present invention in any manner.

COMPARATIVE EXAMPLE 1

Lab experiments were carried out to simulate a commercial paper making operation, in which T-100, a Clariant's tetrasulphonated OBA product, was added into three bleached hardwood Kraft pulp samples. A low speed lab Warring blender was used for mixing pulp with all chemicals. Prior to the optical brightener ("OBA") addition, deionized water was added into the 5 gm oven dry pulp sample to reduce its consistency to 1% consistency. Shortly after the OBA addition, 5 ml of 5% alum solution of alum was added into the pulp mixture to complete the attachment of all OBA onto the fiber. After one minute mixing in the blender, the pulp mixture was dewatered to form a brightness pad, following the standard Tappi pulp brightness testing procedure. Three pulp samples and three dosage of T-100 were used in these experiments. Brightness results on individual pulp samples, before and after OBA fixation, are as follows:

TABLE 1

| | Hardwood #1 | | Hardwood #2 | | Hardwood #3 | |
|---|---|---|---|---|---|---|
| | Brightness (GE) | Brite Gain | Brightness (GE) | Brite Gain | Brightness (GE) | Brite Gain |
| 0 | 80.5 | 0 | 84.4 | 0 | 86.6 | 0 |
| 4 | 83.1 | 2.6 | 87.7 | 3.3 | 90.0 | 3.5 |
| 8 | 84.2 | 3.7 | 89.7 | 5.1 | 90.4 | 3.8 |
| 16 | 84.9 | 4.3 | 89.4 | 5.0 | 90.7 | 4.1 |

COMPARATIVE EXAMPLE 2

Lab experiments were carried out to simulate a commercial paper making operation in which T-100, a Clariant's tetrasulphonated OBA product, was added into one southern hardwood Kraft pulp sample. A low speed lab Warring blender was used for mixing pulp with all chemicals. Prior to the OBA addition, deionized water was added into the 5 gm oven dry pulp sample to reduce its consistency to 1% consistency. For experiments in series I, shortly after the OBA addition, 5 ml of 5% alum solution of alum was added into the pulp mixture to complete the attachment of all OBA onto the fiber. No alum was used for experiments in series II. For both cases, after one minute mixing in the blender, the pulp mixture was dewatered to form a brightness pad, following the standard Tappi pulp brightness testing procedure. Three pulp samples and three dosage of T-100 were used in these experiments. Brightness results on individual pulp samples, before and after OBA fixation, are as follows:

TABLE 2

| | Series I - No Alum | | Series II - With Alum | |
|---|---|---|---|---|
| | Brightness (GE) | Brite Gain | Brightness (GE) | Brite Gain |
| 0 | 84.0 | 0 | 84.0 | 0 |
| 3 | | | 87.4 | 3.4 |
| 6 | | | 89.0 | 5.0 |
| 10 | | | 89.7 | 5.7 |
| 20 | 85.8 | 1.8 | 89.1 | 5.1 |
| 40 | 86.4 | 2.3 | 86.2 | 2.1 |
| 60 | 86.7 | 2.7 | 82.2 | 1.8 |

TABLE 3

| | Series I - No Alum | | Series II - With Alum | |
|---|---|---|---|---|
| | Brightness (GE) | Brite Gain | Brightness (GE) | Brite Gain |
| 0 | 84.0 | 0 | 84.0 | 8 |
| 3 | | | 87.4 | 3.4 |
| 6 | | | 89.0 | 5.0 |
| 10 | | | 89.7 | 5.7 |
| 20 | 85.8 | 0.8 | 89.1 | 5.1 |
| 40 | 86.4 | 2.3 | 86.2 | 2.1 |
| 60 | 86.7 | 2.7 | 82.2 | 1.8 |

TABLE 4

| T-100 | Reaction | Water Bath at 60° C. | | Water Bath at 75° C. | |
|---|---|---|---|---|---|
| Charge (lbs/ton) | Time (Hours) | Brightness (GE) | Brite Gain | Brightness (GE) | Brite Gain |
| 0 | 0 | 88.9 | 0 | 88.9 | 0 |
| 2 | 1 | 93.0 | 4.1 | 91.8 | 2.9 |
| 4 | 1 | 93.6 | 4.6 | 93.4 | 4.5 |
| 8 | 1 | 94.9 | 6.0 | 94.7 | 5.8 |
| 0 | 0 | 88.9 | 0 | 88.9 | 0 |
| 2 | 5 | 92.2 | 3.3 | 92.0 | 3.1 |
| 4 | 5 | 93.6 | 4.6 | 92.7 | 3.8 |
| 8 | 5 | 94.0 | 5.1 | 93.9 | 4.9 |

EXAMPLE 1

From a commercial IP pulp mill in Southern US, samples of fully bleached hardwood and softwood Kraft pulp at the exit of the bleach plant were collected and used in high consistency OBA fixation experiments. Experimental conditions, including OBA type and pulp consistency were identical to those described in example 1. The as-received softwood pulp sample has a pH of 5.2 and the pH for the hardwood pulp sample was 6.7. All experiments were carried out for a duration of two hours, in 65° C. temperature bath. Prior to some of experiments on hardwood pulp, dilute hydrochloric acid solution was also added to the as-received mill pulp to lower its pH to 4.9 during the reaction with OBA. The following results were obtained:

TABLE 5

| T-100 | Softwood at 5.2 pH | | Hardwood at 6.7 pH | | Hardwood at 4.9 pH | |
|---|---|---|---|---|---|---|
| Charge (lbs/ton) | Brightness (GE) | Brite Gain | Brightness (GE) | Brite Gain | Brightness (GE) | Brite Gain |
| 0 | 85.5 | 0 | 85.6 | 0 | 85.6 | 0 |
| 2.5 | 89.4 | 3.9 | 87.5 | 1.9 | 90.1 | 4.5 |
| 5.0 | 89.7 | 4.2 | 88.5 | 2.9 | 91.3 | 5.7 |
| 10.0 | 91.2 | 5.7 | 89.3 | 3.7 | | |
| 15.0 | 91.5 | 6.0 | 90.2 | 4.6 | 92.4 | 6.8 |

EXAMPLE 2

From a commercial IP pulp mill in Europe, samples of fully bleached softwood and hardwood pulps, leaving the bleach plant were collected and used in OBA fixation experiments. The pH of the filtrate of both pulp samples was 3.0. Leucophor ANO, a disulphonate OBA product produced by Clariant, was used in this example. Fixation experiments were carried out with variable OBA charges, at 10% consistency, for two hours in 65° C. temperature bath. Observed changes in the pulp brightness as results of OBA fixation is as follows:

TABLE 6

| Leucophor | Hardwood | | Softwood | |
|---|---|---|---|---|
| Charge (lbs/ton) | Brightness (GE) | Brite Gain | Brightness (GE) | Brite Gain |
| 0 | 89.3 | 0 | 88.4 | 0 |
| 5 | 93.6 | 4.3 | 92.8 | 4.3 |
| 10 | 94.3 | 4.9 | 92.1 | 3.7 |
| 15 | 92.7 | 3.4 | 90.4 | 2.0 |
| 20 | 91.9 | 2.6 | 89.6 | 1.1 |
| 30 | 89.3 | 0 | 86.0 | −2.5 |

EXAMPLE 3

Samples of pulps and OBA of example 3 were used in this example. However, before mixing with OBA, dilute solution of NaOH as used to raise the pH of the pulp samples, from 3.0 to 5.7 for the case of hardwood and to 7.0 for the case of softwood. All other conditions were identical to those used in example 4. Observed changes in the pulp brightness as results of pH adjustment and OBA fixation is as follows:

TABLE 7

| Leucophor | Hardwood | | Softwood | |
|---|---|---|---|---|
| Charge (lbs/ton) | Brightness (GE) | Brite Gain | Brightness (GE) | Brite Gain |
| 0 | 89.0 | 0 | 87.9 | 0 |
| 4 | 93.4 | 4.4 | 92.5 | 4.6 |
| 8 | 94.9 | 5.8 | 93.8 | 5.9 |
| 12 | 95.1 | 6.3 | 94.0 | 6.1 |
| 20 | 95.5 | 6.5 | 94.8 | 6.8 |
| 30 | 89.3 | 6.6 | 95.1 | 7.2 |

EXAMPLE 4

Experiments were carried out to fix T-100 on to commercially produced fully bleached softwood and hardwood Kraft pulp samples from a Northern US mill. The softwood pulp has a freeness of 690 csf, brightness of 90 GE and pH of 4.0. The hardwood sample has a freeness of 570 csf, brightness of 89.2 and pH of 4.0. Variable dosages of T-100 were mixed with pulps at 10% consistency and were kept in separate and sealed plastic bags. Bags were placed in 70° C. water bath for 2 hours. Change in the brightness of individual pulp samples as a result of OBA fixation is as follows:

TABLE 8

| T-100 | Softwood | | Hardwood | |
|---|---|---|---|---|
| Charge (lbs/ton) | Brightness (GE) | Brite Gain | Brightness (GE) | Brite Gain |
| 0 | 90.0 | 0 | 89.2 | 0 |
| 2 | 94.4 | 4.4 | 92.0 | 2.8 |
| 4 | 95.2 | 5.2 | 92.7 | 3.5 |
| 6 | 95.8 | 5.8 | 93.3 | 4.1 |
| 8 | 96.3 | 6.3 | 93.8 | 4.6 |
| 10 | 96.6 | 6.6 | 94.2 | 5.0 |
| 12 | 97.1 | 7.1 | 94.3 | 5.1 |

EXAMPLE 6

The original softwood and hardwood pulp samples of example 5, together with samples which were fixed with 12 lbs/bdt of T-100, were subjected to high shear mechanical action inside a lab PFI refiner. The extent of pulp refining was controlled so that the freeness of the softwood pulp is reduced from 690 CSF before refining to 450 CSF after refining. For the hardwood pulp, the freeness drop was from 570 CSF to 330 CSF. Brightness changes, as a result of PFI refining, on original pulp samples and samples containing OBA are as follows:

TABLE 9

| | Softwood | | | Hardwood | | |
|---|---|---|---|---|---|---|
| | Before fixation | After fixation | Gain | Before fixation | After fixation | Gain |
| Before refining | 90.0 | 96.6 | 6.6 | 89.2 | 94.2 | 5.0 |
| After refining | 88.4 | 94.7 | 6.3 | 88.4 | 94.0 | 5.6 |
| Loss | 1.6 | 1.9 | | 0.8 | 0.2 | |

Brightness loss as a result of pulp refining operation is well recognized in papermaking. Under refining condition used in example 6, it was 1.6 points for the original softwood and 0.8 points for the original hardwood. Brightness losses were very similar for the case where pulps were fixed with OBA, suggesting that the created bonding between OBA and fiber was very strong and was not affected by the mechanical shear action of the refiner. The net brightness gain, obtained from OBA fixation, remained essentially unchanged and were not affected by the pulp refining process.

EXAMPLE 6

Hand Sheet Study

Summary

The handsheet study confirmed that adding Clariant Leucophor ANO optical brightening agent (OBA) under high consistency treatment method gave better brightness than when the OBA was added at low consistency.

For a fixed dose, the new addition point resulted in a brightness increase of about 1.9 units of ISO brightness.

Based on this study, to reach the same ISO brightness, changing to the new addition method would allow the OBA dosage to be decreased by 3.5 pounds/ton.

These estimates are based on data at OBA dose levels between 3.3 and 10 pounds/ton.

The designed experiment showed that two of the factors, OBA dose (nominally 3.3 and 10 pounds/ton) and OBA addition method (new method vs addition to low consistency pulp) were statistically significant in determining brightness.

Experimental

Pulp

Pulp used for this study was unrefined hardwood and softwood taken from the washer of the last bleaching stage.

1. OBA Fixation

The hardwood and softwood pulps separately with two levels of OBA, 3.3 and 10 pounds/ton of OBA. The OBA used was Leucophor ANO (Clariant), which is a di-sulfonated OBA. The conditions were 10% consistency, mixed for 2 hours at 70° C.

2. Refining

Prior to refining, the pulps were combined into a 70:30 HWD:SWD ratio. Refining was performed in the LR1, a laboratory disk refiner. Two energies were used, 35 kW/T and 45 kW/T. The freeness of the resulting pulps were ~580 and ~320 csf, respectively.

3. Sheet Making

Sheets were made on the dynamic sheet former with the following procedure: The pulp was diluted to 1% consistency and mixed vigorously. SMI's Albacar LO PCC was added first and allowed to mix for 1 minute. Then a predetermined and accurate amount of OBA was added and mixed for 15 minutes. The sheet was then formed. After forming, the sheets were pressed to ~45% solids and dried at 230° F. on the drum drier. Special precautions were made so that the sheets with 'fixed' OBA had similar amounts of OBA as the standard OBA addition sheets. In addition to the samples pretreated with OBA and the samples prepared as describe here, where the PCC was added before the OBA, several controls were also made where the order of addition of the PCC and OBA was reversed (OBA first).

4. Testing

The handsheets were tested for various optical properties using the DataColor Elrepho Spectrophotometer.

5. Experimental Design

The design for this experiment included four main factors:

I) Stock consistency at which the OBA was added (10% vs. 1%)

II) Refining (35 kW/T vs. 45 kW/T)

III) Filler Level (10% vs. 20%)

IV) OBA dose (3.3 lb/T vs. 10 lb/T)

Figure 4:
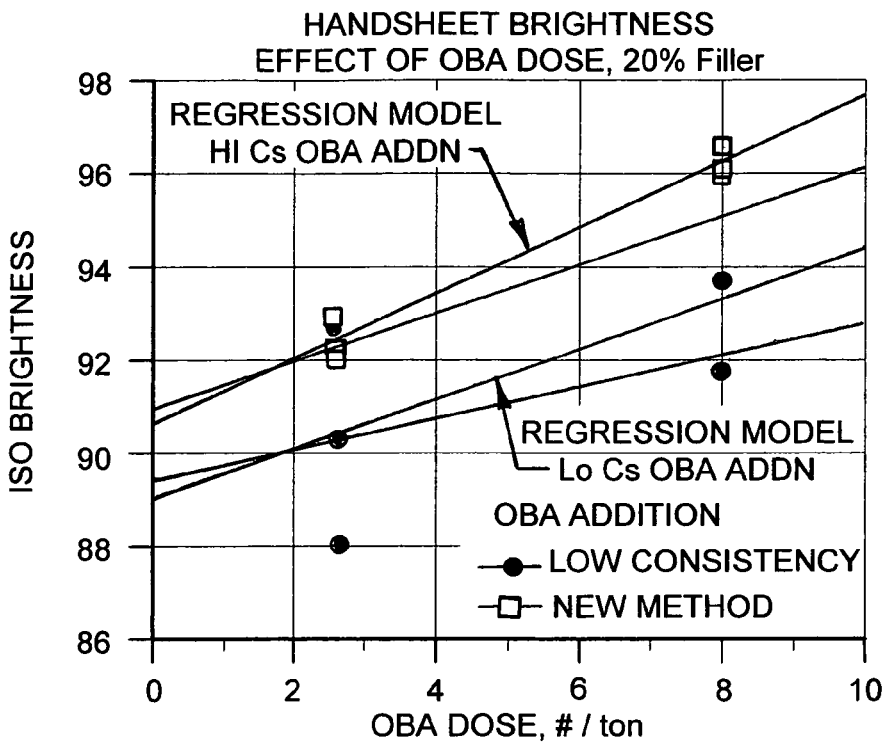
FIG. 4: Graphs of ISO Brightness v.s OBA Level of Handsheets made from pulp treated with OBA effect of OBA dose in the presence of 10 and 20% filler, regression lines added.
Figure 4:
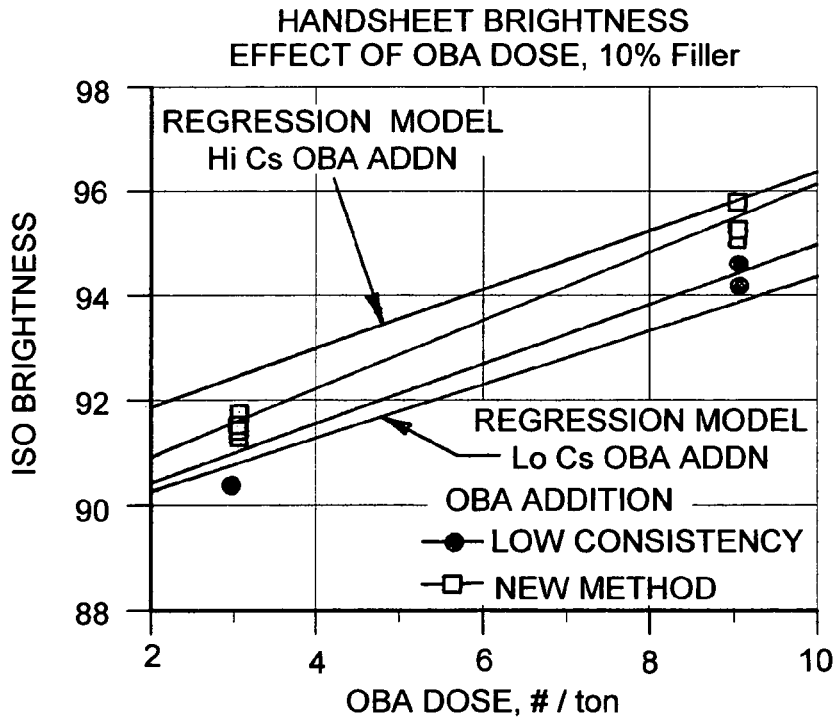

Results & Conclusions:

Comparison of Handsheet Brightness for New and Traditional Fixation methods:

Adding Clariant Leucophor ANO optical brightening agent (OBA) under the new, high consistency treatment method gave better brightness than when added at low consistency to handsheets. The results are set forth in the following FIG. 1 to FIGS. 1-4 shows all the brightness data from the study graphed against OBA dose. There are several different classes of samples listed, separated by the fixation method (high and low consistency) and filler level (10 and 20 #/ton).

Figure 5:
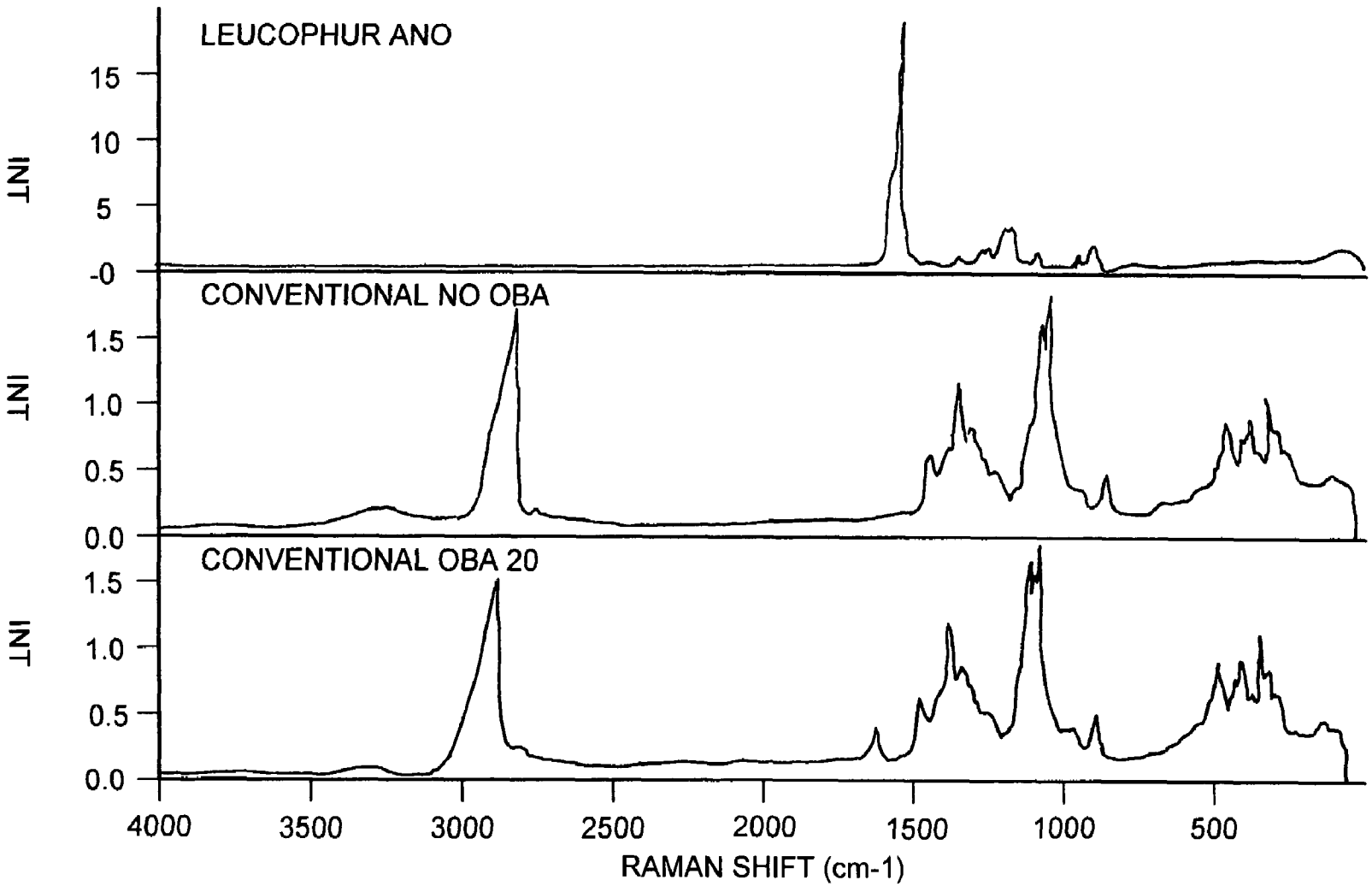
FIG. 5: Raman spectra of OBA only and pulp with different levels of OBA added conventionally.
Figure 6:
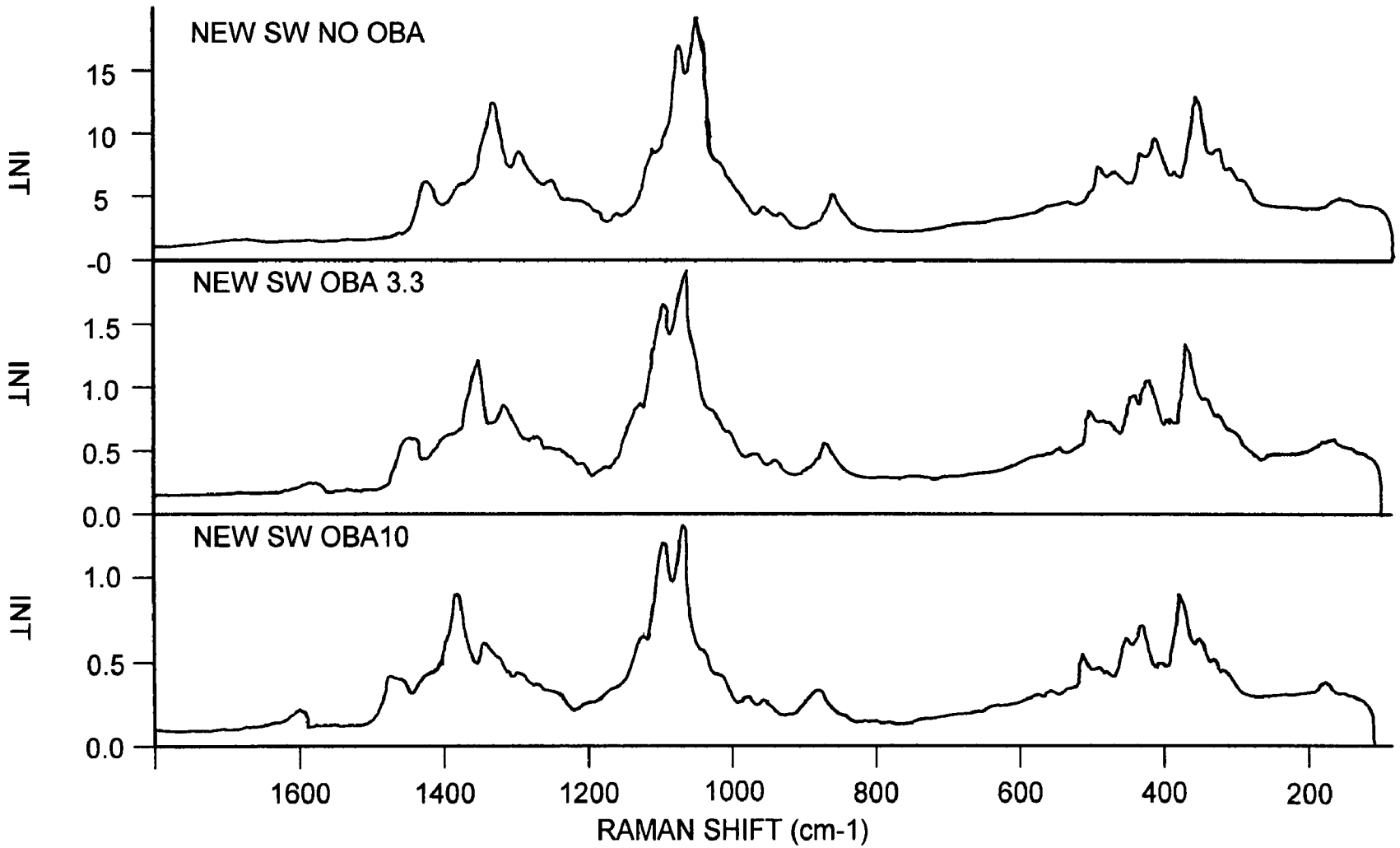
FIG. 6: Raman spectra of pulp with different levels of OBA added according to one aspect of the present invention.
Figure 7:
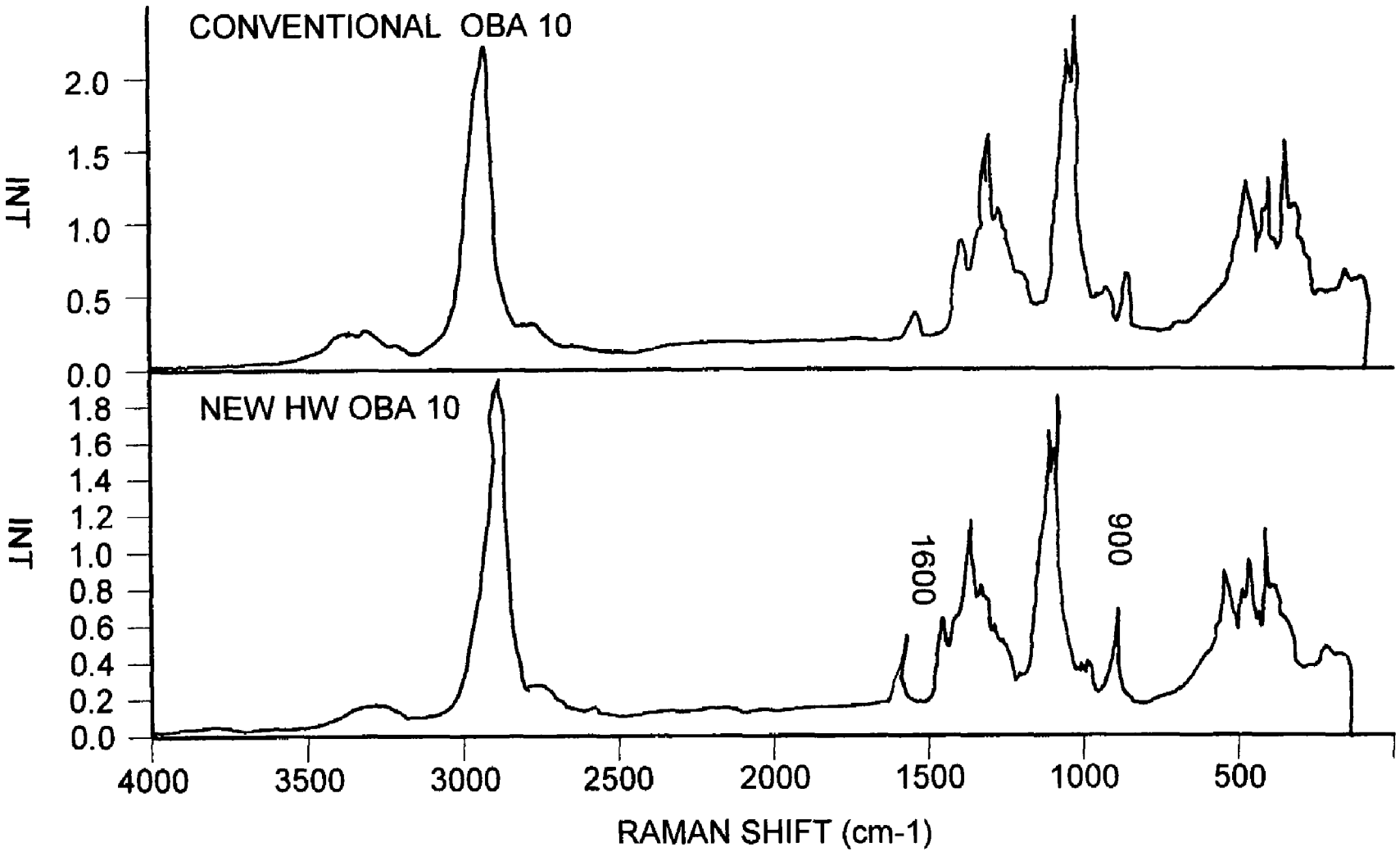
FIG. 7: Raman spectra of pulp with different levels of OBA added conventionally and added according to one aspect of the present invention.
Figure 8:
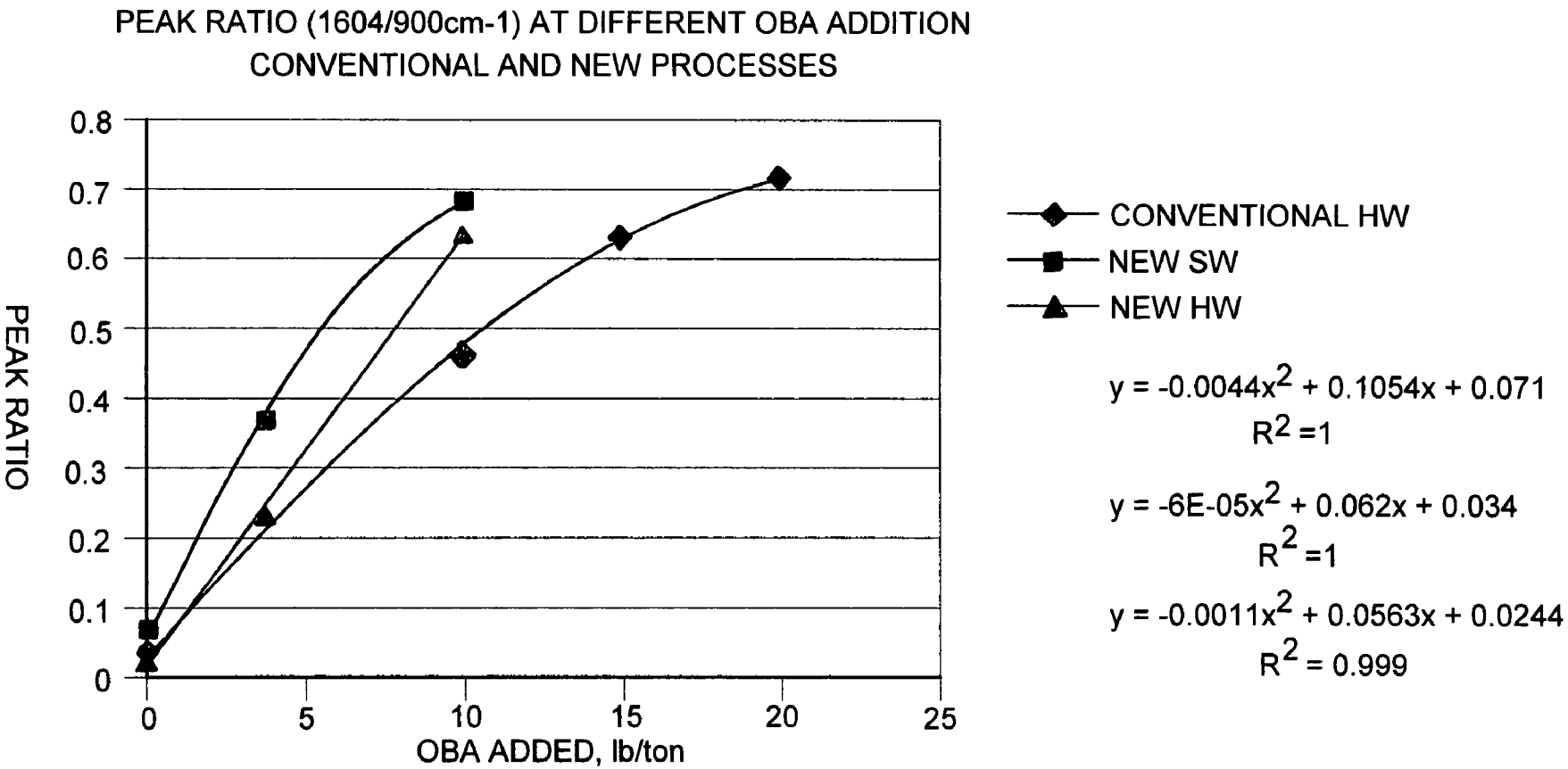
FIG. 8: Graph of the peak ratio (1604/900 $cm^{-1}$) within Raman spectra of pulp with different levels of OBA added conventionally and added according to one aspect of the present invention (Hardwood and Softwood) as depicted in Table 10.

Raman Spectroscopy Study of Pulp with OBA:

Raman spectroscopy was used to study pulp with OBA added using the conventional as well as new processes. FIG. 5 compares the spectrum of OBA (Leucophur ANO) with spectra of pulp with and without OBA added. The most intensive peak at the spectrum of the OBA at approximately 1600 $cm^{-1}$ is visible in the spectrum of pulp with the OBA added. FIG. 6 shows spectra of pulp (expanded region from 300 to 1700 $cm^{-1}$) with different levels of OBA added in the process. The intensity of the peak at 1600 $cm^{-1}$ increased with increased level of the OBA. When spectra of the pulp with OBA added in the conventional and the new process were compared, there were no changes in the shape of the peaks and no addition peaks were observed (see FIG. 7). In order to determine the relative amount of OBA retained on the fibers, the ratio of the intensity of the maximum at 1600 $cm^{-1}$ to the intensity of the peak at 900 $cm^{-1}$ (cellulose peak) was calculated for pulps with different OBA levels added in the process. The results are presented in the table and the FIG. 8.

TABLE 10

| Process | OBA added, lb/ton | Peak Ht ratio |
|---|---|---|
| Conv | 0 | 0.026 |
| | 10 | 0.469 |
| | 15 | 0.637 |
| | 20 | 0.711 |
| New HW | 0 | 0.034 |
| | 3.3 | 0.238 |
| | 10 | 0.648 |
| New SW | 0 | 0.071 |
| | 3.3 | 0.371 |
| | 10 | 0.685 |

The results of Raman measurements indicate that the amount of OBA in the pulp produced in the new process at 10 lb/ton in comparable to the amount of OBA in the pulp obtained in the conventional process at 15-20 lb/ton loading Inductively Coupled Plasma Spectroscopy (ICP) Study of OBA in Pulp:

Samples of softwood and hardwood pulp with OBA added during the conventional and new processes were hot plate digested with hydrogen peroxide and nitric acid. A sample of OBA used in the process was dried and digested under the same conditions. The digested samples were analyzed for sulfur content by ICP. The results are presented in the table below. Untreated pulp was also analyzed under the same conditions and determined sulfur concentrations were subtracted from the concentrations in the treated pulp in order to establish the amount of OBA present in the pulp, which is reported on the dry weight of the OBA.

| Process | OBA added, lb/ton | Sulfur from ICP, ppm | S from OBA on fiber, ppm | OBA on fiber, ppm (based on S results) |
|---|---|---|---|---|
| Conv | 0 | 150 | | |
| | 10 | 190 | 40 | 697 |
| | 20 | 250 | 100 | 1744 |
| New HW | 0 | 140 | | |
| | 10 | 250 | 110 | 1918 |
| New SW | 0 | 66 | | |
| | 10 | 150 | 84 | 1465 |
| OBA (oven dry) | | 57600; 57100 | | |

The sulfur concentrations in the pulp indicate that the amount of OBA present in the pulp treated in the new process at 10 lb/ton OBA is comparable to the amount of the pulp from the conventional process at 20 lb/ton loading.

Extraction Studies:

Approximately 1 gram of pulp was cut into small pieces and soaked in approximately 150 ml. of water for 6 hours at 60 degrees C.

The water extracts were filtered through a 0.45 μm filter, reduced to approximately 2 ml volume in a LABCONCO Rapidvap Nitrogen Evaporation System using air as the purge gas. The Evaporator was run at 24% vortex speed at a temperature of 30° C. After evaporation to approximately 2 ml. the sample was brought to 5 ml. in a volumetric flask.

A portion of this water 5 ml. extract was analyzed by high performance liquid chromatography (HPLC).

A portion of the 5 ml. water extract was diluted 1:10 for the UV/VIS analysis.

The HPLC Instrumental Conditions are Below:

Instrument description: Waters Alliance 2695 separation module with a Waters model 996 Photodiode Array Detector (PDA)

Mobile phase: 50% methanol 50% PIC-A buffer solution at 0.7 ml minute. PIC-A is sold by the Waters Corporation and is a reverse phase ion pairing buffer solution composed of 0.005 m tetrabutyl ammonium phosphate buffered to a pH of 7.5.

Column: Phenomenex Luna 5 μ C-8 (2) 250 mm×4.6 mm, operated at 35° C.

Detector: Waters 400 photo diode array detector (PDA) over the range of 200-800 nm. The peak at 254 nm was selected for the analysis.

Run Time: 60 minutes

Injection Volume: 10 μl

The UV/VIS Instrumental Conditions are Below:

Instrument description: Shimadzu model UV-160 operated in the photometric mode.

Wavelength used for analysis: 350 nm.

Figure 9:
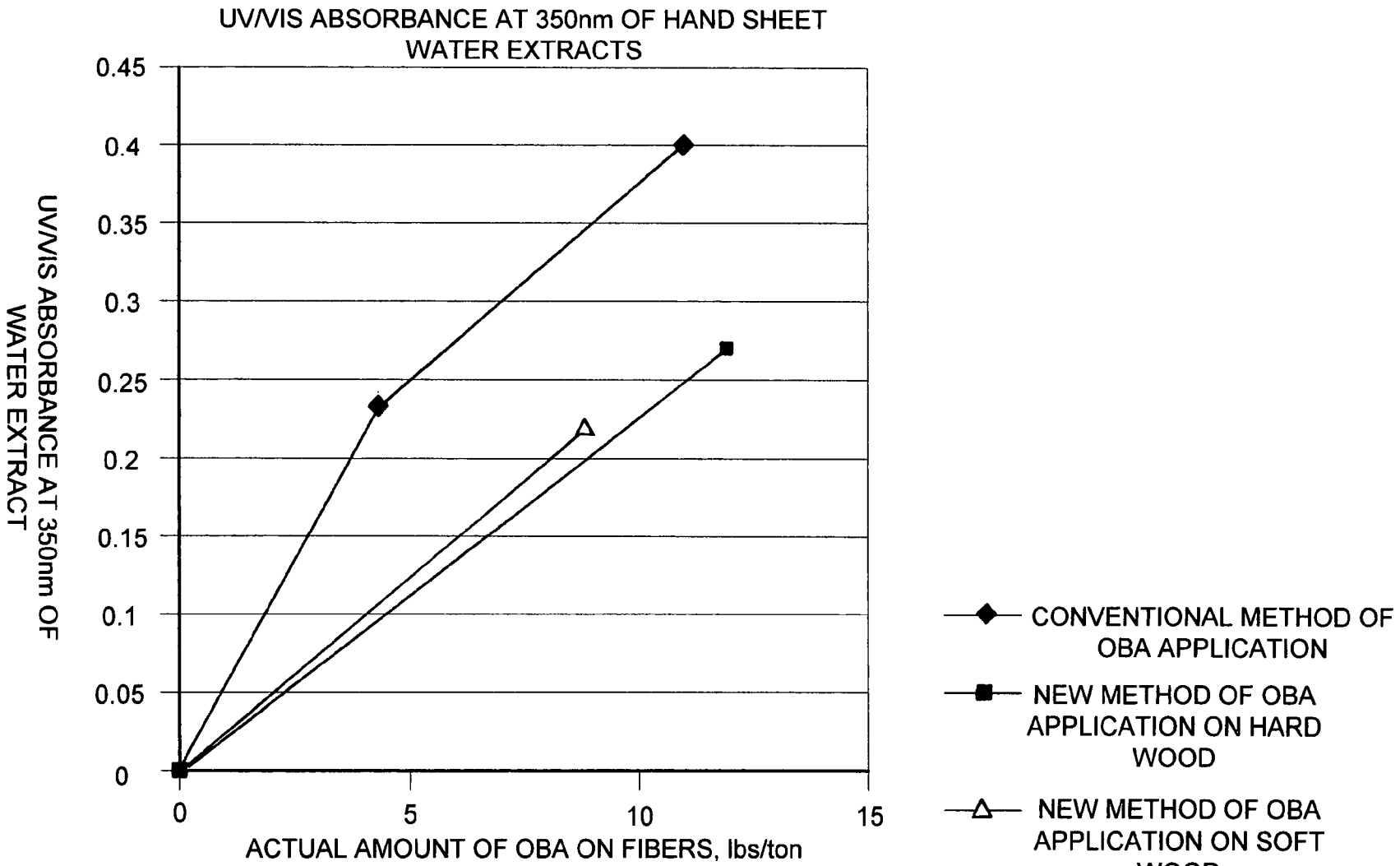
FIG. 9: UV/VIS absorbance at 350 nm of water extract vs. Actual Amount of OBA on fibers, lbs/ton.
Figure 10:
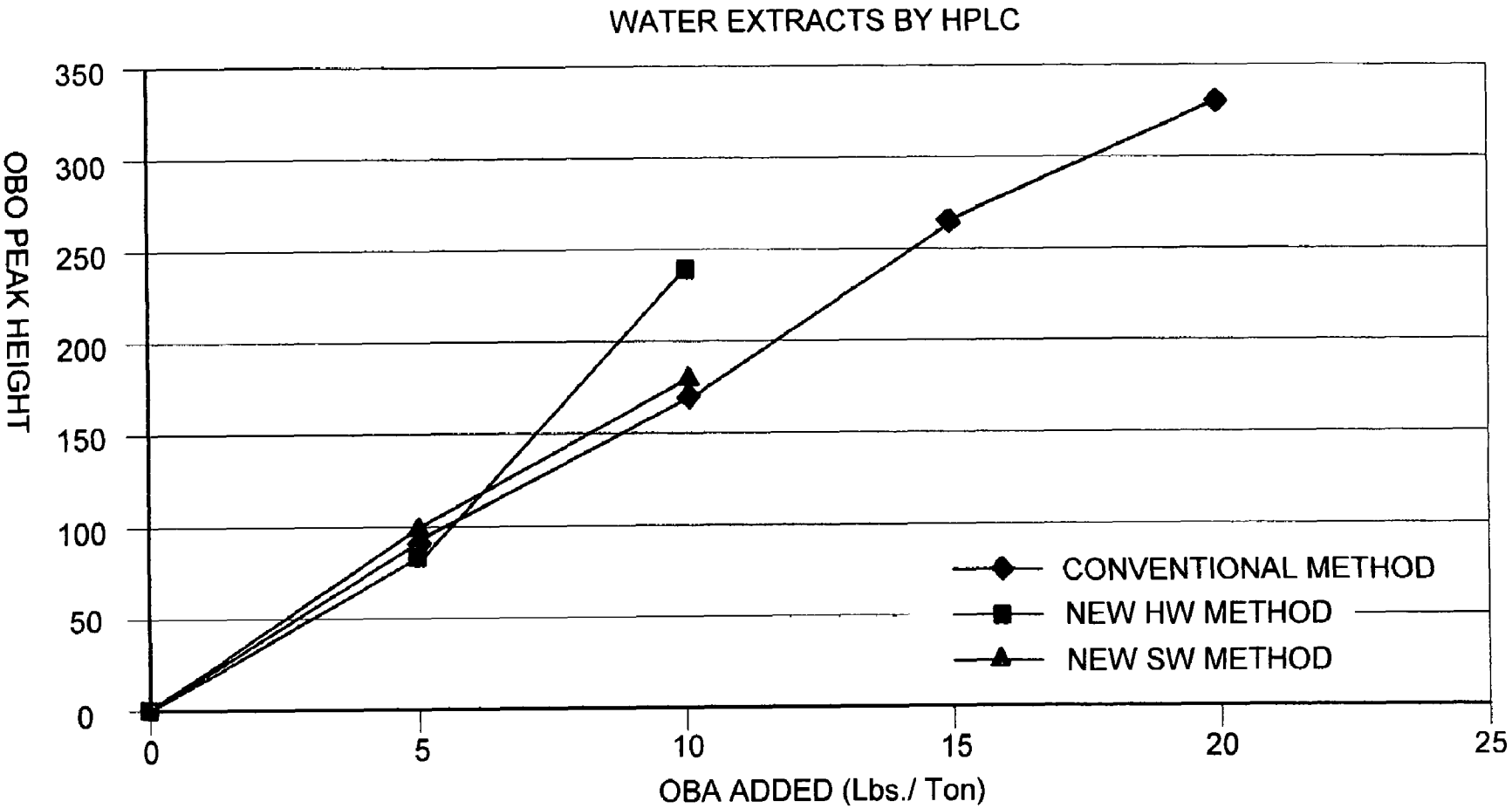
FIG. 10: OBA peak height vs. OBA added (lbs/ton) via the conventional addition method and added according to one aspect of the present invention (Hardwood and Softwood).
Figure 11:
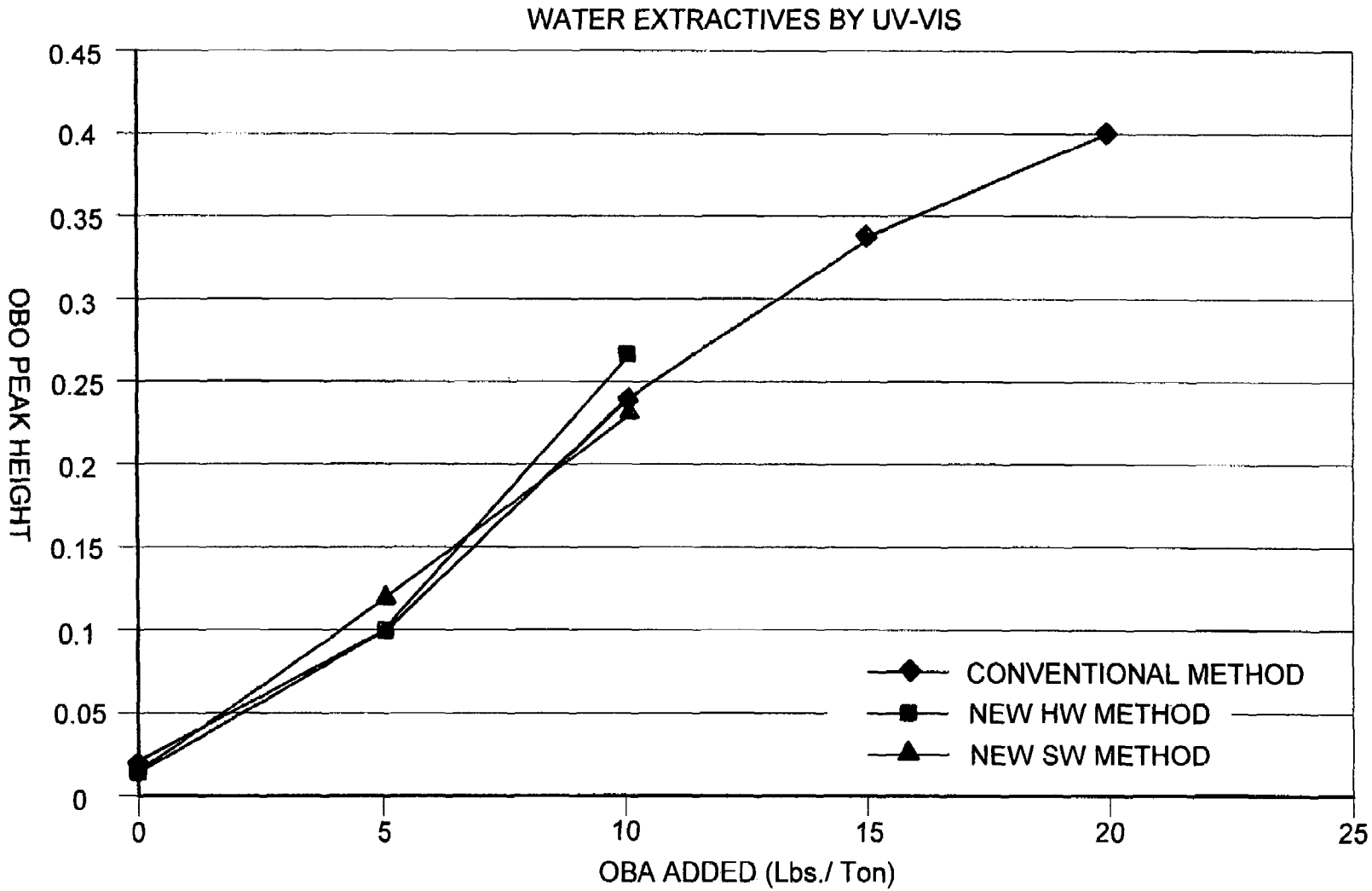
FIG. 11: OBA peak height vs. OBA added (lbs/ton) via the conventional addition method and added according to one aspect of the present invention (Hardwood and Softwood).

The results are set forth in FIGS. 9-11

Numerous modifications and variations on the present invention are possible in light of the above teachings. It is, therefore, to be understood that within the scope of the accompanying claims, the invention may be practiced otherwise than as specifically described herein.

As used throughout, ranges are used as a short hand for describing each and every value that is within the range, including all subranges therein.

All of the references, as well as their cited references, cited herein are hereby incorporated by reference with respect to relative portions related to the subject matter of the present invention and all of its embodiments.

The invention claimed is:

1. A method of making pulp and/or a paper substrate, comprising bleaching/extracting a plurality of Kraft fibers with a chlorine based bleaching agent for the final time;

after bleaching/extracting, washing the plurality of bleached Kraft fibers; and after washing, contacting the plurality of bleached Kraft fibers in solution at a pH of from 3.5 to 5.5 and a temperature of from 60 to 80° C. for a duration of time of from 0.5 to 6 hours with at least one optical brightener during or after non-chlorine bleaching/extracting and prior to both a blend chest stage and a machine chest stage.

2. The method according to claim 1, wherein the fibers in solution are at a consistency of greater than about 4%.

3. The method according to claim 1, wherein the fibers in solution are a consistency of from 7 to 15%.

4. The method according to claim 1, wherein from 1 to 15 lbs/ton of OBA is contacted with the fibers.

5. The method according to claim 1, wherein the contacting is performed at a point in the pulp making or papermaking process prior to a refining stage.

6. The method according to claim 1, wherein said contacting is performed in the absence of a retention aid.

7. The method according to claim 1, further comprising contacting additional OBA with the fibers at a coater.

8. The method according to claim 1, further comprising contacting additional OBA with the fibers at a size press.

9. The method according to claim 1, wherein the fibers in solution are a consistency of from 10 to 12%.

10. The method according to claim 1, wherein the plurality of bleached Kraft fibers in solution have an ISO Brightness that is less than 90 prior to contacting the plurality of bleached Kraft fibers in solution with the at least one optical brightener and an ISO Brightness that is greater than or equal to 90 after contacting the plurality of bleached Kraft fibers in solution with the at least one optical brightener.

11. The method according to claim 1, wherein the plurality of bleached Kraft fibers in solution have an ISO Brightness that is less than or equal to 90 prior to contacting the plurality of bleached Kraft fibers in solution with the at least one optical brightener and an ISO Brightness that is greater than or equal to 92 after contacting the plurality of bleached Kraft fibers in solution with the at least one optical brightener.

12. The method according to claim 1, wherein the Kraft fibers are from hardwood trees.

13. The method according to claim 1, wherein the Kraft fibers are from softwood trees.

14. The method according to claim 1, wherein said contacting occurs at a high density storage stage.

15. The method according to claim 1, wherein said contacting occurs at a refining stage.

16. The method according to claim 1, wherein said contacting occurs at a low density storage stage.

* * * * *